US005967506A

United States Patent [19]

Miki et al.

[11] Patent Number: 5,967,506

[45] Date of Patent: Oct. 19, 1999

[54] SHEET CONVEYING METHOD AND APPARATUS

[75] Inventors: Wataru Miki; Koji Hirata, both of Hyogo, Japan

[73] Assignee: Fujitsu Limited, Kawasaki, Japan

[21] Appl. No.: 08/846,208

[22] Filed: Apr. 28, 1997

[30] Foreign Application Priority Data

Nov. 22, 1996 [JP] Japan ..... 8-312348

[51] Int. Cl.[6] ..... B65H 5/00

[52] U.S. Cl. ..... 271/10.13; 271/3.17; 271/242

[58] Field of Search ..... 271/10.13, 114, 271/116, 10.11, 10.01, 242

[56] References Cited

U.S. PATENT DOCUMENTS

| | | | |
|---|---|---|---|
| 4,645,192 | 2/1987 | Watanabe | 271/10.13 |
| 5,634,635 | 6/1997 | Kobayashi et al. | 271/3.17 |
| 5,775,685 | 7/1998 | Yamaoka et al. | 271/10.13 |

FOREIGN PATENT DOCUMENTS

| | | |
|---|---|---|
| 35 38 441 A1 | 4/1986 | Germany . |
| 1-299139 | 12/1989 | Japan . |
| 2 299 071 | 9/1996 | United Kingdom . |

*Primary Examiner*—Christopher P. Ellis
*Assistant Examiner*—Gregory A. Morse
*Attorney, Agent, or Firm*—Armstrong, Westerman, Hattori, McLeland & Naughton

[57] ABSTRACT

A printer constituted to drive a pair of feed rollers FR3 and a pair of resist rollers RR so that the leading end of paper P may one stop at a position of a paper sensor S1 at the upstream side when reaching the resist rollers RR and then the entire paper P may be conveyed at a second conveying speed, when conveying a sheet of paper P at a relatively fast first conveying speed by the feed rollers FR3, and conveying at a second conveying speed lower than the first conveying speed by aligning the leading end by the resist rollers RR. It solves the problems of error in printing starting position due to slipping-out of the leading end of the paper from the resist rollers, failure in control to a desired deflection amount when deflecting the paper by colliding with the resist rollers, impact noise when the paper collides with the resist rollers, especially impact noise in thick paper, and possibility of oblique running after passing through the resist rollers.

8 Claims, 7 Drawing Sheets

SHEET CONVEYING METHOD AND APPARATUS

BACKGROUND OF THE INVENTION

The present invention relates to a sheet like object conveying method and apparatus for conveying a sheet like object to a predetermined position, and more particularly to an improvement of its conveying sequence. It also relates to a structural example of the sheet like object conveying apparatus of the invention realized in an electrophotographic apparatus or the like as a paper conveying apparatus, and a printer using the same.

The paper conveying sequence in a recent electrophotographic apparatus in which a paper conveying apparatus is incorporated as an important constituent element often fails to convey the paper normally due to such factors as high speed processing and increase of paper variations (various paper qualities, thicknesses). A more specific description is given below.

FIG. 1 is a schematic longitudinal sectional view showing an internal structural example of a general electrophotographic printer having a paper conveying apparatus as a conventional sheet like object conveying apparatus. In FIG. 1, a paper cassette 1 is disposed beneath the printer, and a developing device 3 and a fixing device 4 are disposed thereabove.

A photosensitive drum 31 is provided in the developing device 3, and a pair of heating and fixing rollers 41 is disposed in the fixing device 4. A pair of exit rollers ER is disposed near a paper outlet of the fixing device 4.

A pickup roller PR is disposed in the paper cassette 1. This pickup roller PR takes out uppermost one sheet from a stock of sheets stacked up in the paper cassette 1. Near the paper inlet of the developing device 3, a pair of resist rollers RR is disposed. Plural pairs of feed rollers FR1, FR2, . . . are disposed between the pickup roller PR and pair of resist rollers RR, and by these plural pairs of feed rollers FR1, FR2, . . . , pair of resist rollers RR, photosensitive drum 31, pair of heating and fixing rollers 41, and pair of exit rollers ER, the paper conveying path is formed as indicated by single dot chain line in FIG. 1. In the example shown in FIG. 1, there are three pairs of feed rollers FR1, FR2, FR3, but this is only an example and it is not limited particularly.

In the printer having the paper conveying apparatus as the conventional sheet like object conveying apparatus as shown in FIG. 1, the operation is as follows. First, one sheet is taken out from the paper cassette 1 by the pickup roller PR, and is conveyed into the developing device 3 through the feed rollers FR1, FR2, FR3 and resist rollers RR. On the other hand, data given from a host apparatus not shown (for example, personal computer or word processor) is emitted on the photosensitive drum 31 of the developing device 3 by the optical unit 2, and a latent image is formed. The latent image formed on the photosensitive drum 31 is developed by the toner to be a sensible image, which is transferred on the paper, and it is further conveyed to the fixing device 4 to be heated and fixed, and is discharged into a discharge tray 7 through the pair of exit rollers ER.

The paper conveying sequence from the paper cassette 1 to the developing device 3 in the paper conveying apparatus of the above case is described in detail below.

When paper conveying is instructed, the pickup roller PR, and feed rollers FR1, FR2, FR3 are driven to rotate at predetermined speeds, but the pair of resist rollers RR is not driven and remains stopped. In such state, the paper taken out from the paper cassette 1 by the pickup roller PR is conveyed in the sequence of the feed rollers FR1, FR2, FR3, and is conveyed until colliding with the pair of resist rollers RR in stopped state. The reason why the pair of resist rollers RR is not rotating herein is that collision of the paper with the pair of resist rollers RR in stopped state causes to deflect the paper of the pressing force of the pair of feed rollers FR3 immediately at the upstream side, so that the leading end of the paper is collided with the contacting portion of pair of resist rollers RR to correct the inclination uniformly. It hence must avoid passing-through of the paper through the contacting portion of the pair of resist rollers RR in stopped state, and arrest the paper securely. However, to arrest running of paper by the pair of resist rollers RR, it is a required condition that the paper conveyed at the paper conveying speed (for example, 627 mm/sec) of the feed roller FR immediately at the upstream side of the resist roller RR should be arrested.

After being aligned by the pair of resist rollers RR, the paper is conveyed at a process speed (speed for developing, transferring and fixing, for example, 180 mm/sec) slower than the speed being conveyed up to the pair of resist rollers RR (for example, 627 mm/sec) so as to be developed, transferred and fixed.

In this way, in the paper conveying sequence of the paper conveying apparatus as the conventional conveying apparatus of sheet like object, the inclination of the paper end is aligned uniformly by deflecting by colliding the leading end of the paper in the midst of conveyance with the contacting portion of the pair of resist rollers in stopped state at a relatively high speed, and then it is conveyed at a relatively low speed. Such prior art is disclosed, for example, in Japanese Patent Application Laid-open No. 1-299139 (1989).

Meanwhile, as mentioned above, the paper conveying sequence of the paper conveying apparatus in the recent electrophotographic apparatus is required to be higher in paper conveying speed and enhanced in the conveying capacity, in conditions including high speed processing and increase in paper variation (various paper qualities and thicknesses). However, when the paper conveying speed is fast or the paper is thick, the motion energy of the paper in the conveying process is considerably large, and the paper may not be arrested at the contacting portion of the pair of resist rollers in stopped state, and may sometimes pass through the contacting portion of the pair of resist rollers RR.

As a result, there are many problems such that the paper end may slip out of the pair of resist rollers to cause an error in the print starting position, or desired deflecting amount may not be controlled when deflecting by colliding the paper with the pair of resist rollers, impact noise may occur when the paper collides with the pair of resist rollers, especially in the case of thick paper, or the paper may run obliquely after passing through the pair of resist rollers.

SUMMARY OF THE INVENTION

The invention is devised in the light of such background, and it is an object of the invention to present a sheet like object conveying method and its apparatus for realizing a paper conveying apparatus intended to solve various problems as mentioned above, in that the conveying object such as paper is securely arrested by the resist rollers.

A sheet like object conveying method of the present invention for conveying one piece of sheet like object to be conveyed by feed rollers to collide with a pair of resist rollers in stopped state to align the leading end side in a direction orthogonal to the conveying direction, and then driving both the feed rollers and the resist rollers to convey the object to be conveyed aligned at the leading end side by the resist rollers to a next process, comprises the steps of: controlling the rotating speed of the feed rollers so that the object to be conveyed may be conveyed at a predetermined speed toward the resist rollers; and controlling the rotating speed of the feed rollers so that the conveying speed of the object to be conveyed may be lower than the predetermined speed from a predetermined position before the object to be conveyed collides with the resist rollers until it collides with the resist rollers.

A sheet like object conveying method of the invention further comprises a step of stopping once the rotation of the feed rollers between abovementioned two steps.

In the sheet like object conveying method of the invention, initially, the conveying object is conveyed at a speed necessary for the apparatus, and after the predetermined position just before the conveying object collides with the resist rollers, it is conveyed at a lower speed than the conveying speed so far, and collides with the resist rollers in stopped state, and at this moment the motion energy of the conveying object is decreased. Therefore, the conveying object is once arrested securely by the resist rollers, and the leading end of the conveying object does not slip out of the resist rollers, and oblique running after passing through the resist rollers is prevented, while the impact noise is decreased when the conveying object collides with the resist rollers.

A sheet like object conveying apparatus of the present invention for conveying one piece of sheet like object to be conveyed by feed rollers to collide with a pair of resist rollers in stopped state to align the leading end side in a direction orthogonal to the conveying direction, and then driving both the feed rollers and the resist rollers to convey the object to be conveyed aligned at the leading end side by the resist rollers to a next process, comprises: a detector for detecting when the leading end of the object to be conveyed reaches a predetermined position before arriving at the resist rollers; and control means for controlling the rotating speed of the feed rollers so that the conveying speed of the object to be conveyed may be slower than the conveying speed before, in response to a signal of detection of the leading end of the object to be conveyed by the detector.

A sheet like object conveying apparatus of the present invention incorporating feed rollers driven by a stepping motor and a pair of resist rollers driven or stopped by connecting or disconnecting the rotation of a constant speed rotating motor by a mechanical clutch, for conveying one piece of sheet like object to be conveyed by the feed rollers at a first speed to collide with the resist rollers in stopped state to align the leading end side in a direction orthogonal to the conveying direction, and then synchronizing the feed rollers and the resist rollers to convey the object to be conveyed at a second speed lower than the first speed, comprises: a detector for detecting that the leading end of the object to be conveyed reaches a predetermined position at the upstream side of the resist rollers; and control means for driving the stepping motor so as to convey the object to be conveyed at the first speed until the detector detects the leading end of the object to be conveyed, once stopping the driving of the stepping motor when the detector detects the leading end of the object to be conveyed, then starting to drive the stepping motor so that the object to be conveyed may be conveyed at the second speed, and controlling the mechanical clutch in connection state when the stepping motor reaches the rotating speed for conveying the object to be conveyed at the second speed, and after the leading end of the object to be conveyed collides with the resist rollers.

In the sheet like object conveying apparatus of the invention as described above, the resist rollers are usually driven to rotate at a constant speed by connecting and disconnecting the electromagnetic clutch, and the feed rollers are controlled at variable speed by the stepping motor, but the time required for the stepping motor to accelerate up to the predetermined speed from the stopped state requires a longer time than connecting the electromagnetic clutch from the stopped state, and therefore, first the stepping motor is started, then the electromagnetic clutch is connected. As a result, the conveying object is arrested by the resist rollers and is deflected securely, and therefore the conveying object does not run obliquely after passing through the resist rollers.

A printer of the present invention comprises: a paper conveying apparatus having a detector for detecting that the leading end of a printing paper reaches a predetermined position before arriving at a pair of resist rollers, and a control unit for conveying the printing paper by controlling the driving of feed rollers so that the printing paper may be conveyed at a first speed until the detector detects the leading end of the printing paper, by controlling the driving of the feed rollers so that the conveying speed of the printing paper may be lower than the first speed from the moment of detection of the leading end of the printing paper by the detector until at least the leading end of the printing paper collides with the resist rollers, and by driving the feed rollers then the resist rollers to convey the printing paper at a second speed; and a printing apparatus for printing on the printing paper conveyed at the second speed at the downstream side of the resist rollers.

A printer of the present invention comprises: a paper conveying apparatus having feed rollers driven by a stepping motor, a pair of resist rollers driven or stopped by connecting or disconnecting the rotation of a constant speed rotating motor by a mechanical clutch, a detector for detecting that the leading end of the printing paper reaches a predetermined position at the upstream side of the resist rollers, and a control unit for driving the stepping motor so that the printing paper may be conveyed at a first speed until the detector detects the leading end of the printing paper, once stopping the driving of the stepping motor when the detector detects the leading end of the printing paper, then starting to drive the stepping motor so that the printing paper may be conveyed at a second speed lower than the first speed, and controlling the mechanical clutch in connection state when the stepping motor reaches the rotating speed for conveying the printing paper at the second speed, and after the leading end of the printing paper collides with the resist rollers, to synchronize the feed rollers and the resist rollers, thereby conveying the printing paper at the second speed lower than the first speed; and a printing apparatus for printing on the printing paper conveyed at the second speed at the downstream side of the resist rollers.

Further, the printer of the invention employs the above sheet like object conveying apparatus as the paper conveying apparatus, and oblique running of paper after passing of the resist rollers is prevented, while impact noise is reduced when a thick paper collides with the resist rollers.

The above and further objects and features of the invention will more fully be apparent from the following detailed description with the accompanying drawings.

DESCRIPTION OF THE PREFERRED EMBODIMENTS

Figure 1:
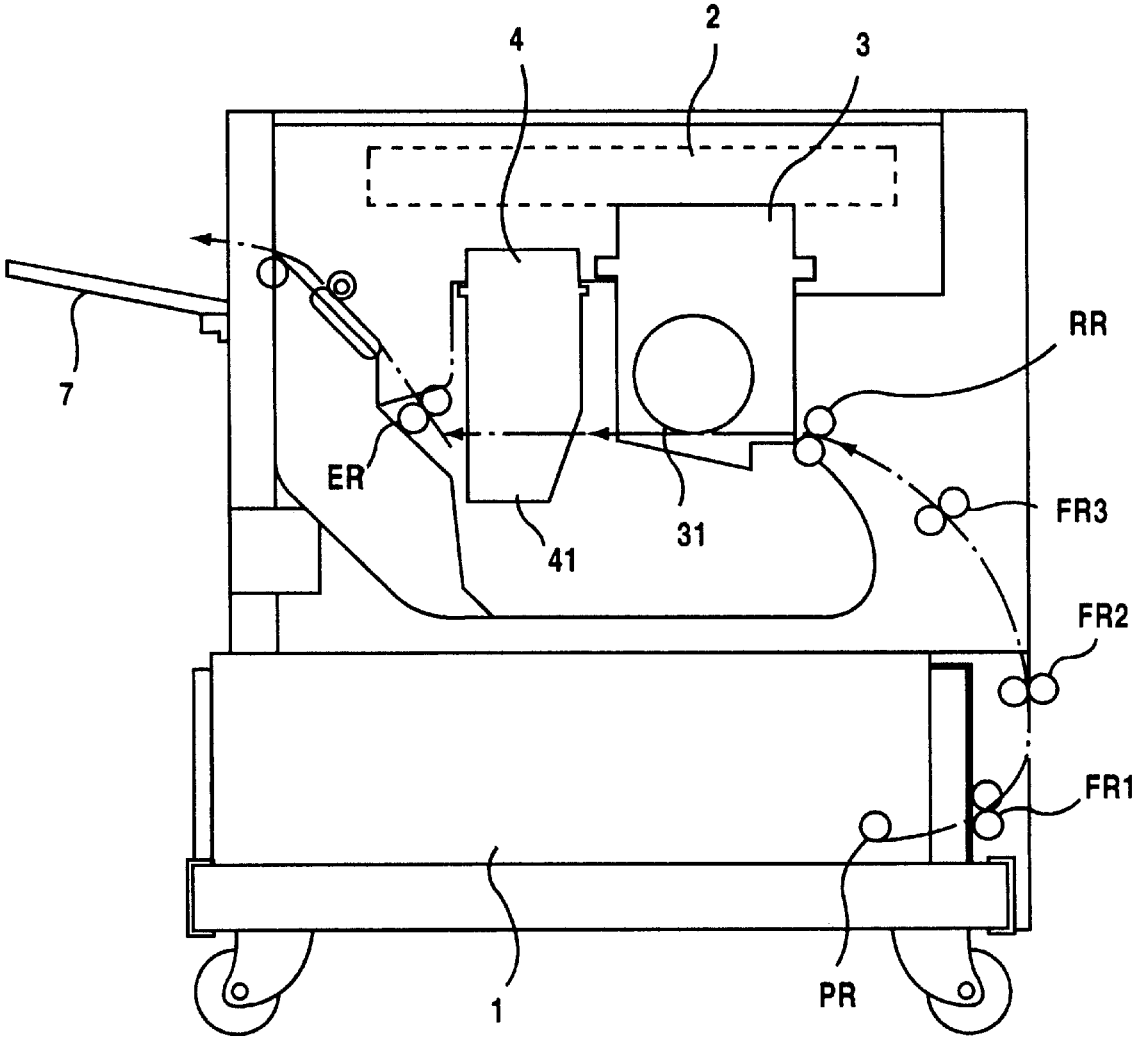
FIG.1 PRIOR ART
FIG. 1 is a schematic longitudinal sectional view showing an internal structural example of an electrophotographic printer having a conventional paper conveying apparatus.
Figure 2:
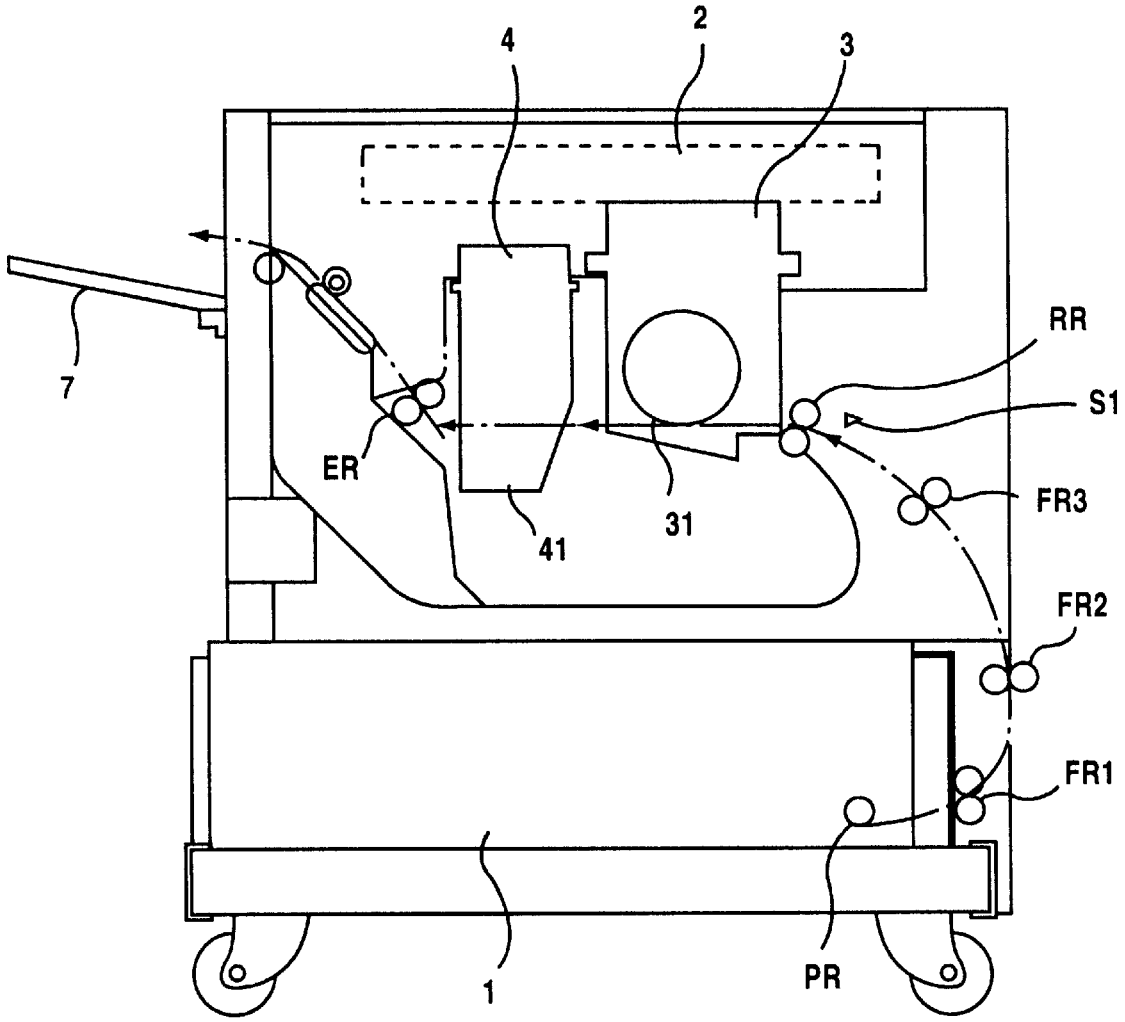
FIG. 2 is a schematic longitudinal sectional view showing an internal structural example of an electrophotographic printer having an apparatus of the invention.

The invention is specifically described below while referring to the drawings showing its embodiments. FIG. 2 is a schematic longitudinal sectional view showing an internal structural example of a printer having a paper conveying apparatus as an example of embodiment of a sheet like object conveying apparatus of the invention, and the basic construction is the same as in the conventional printer.

In FIG. 2, a paper cassette 1 stacking up plural sheets as conveying objects is disposed beneath a printer, and a developing device 3 and a fixing device 4 thereabove. A photosensitive drum 31 is provided in the developing device 3, and a pair of heating and a pair of fixing rollers 41 is disposed in the fixing device 4. A pair of exit rollers ER is disposed near the paper outlet of the fixing device 4. A printing apparatus is composed of an optical unit 2, developing device 3, fixing device 4, and others.

A pickup roller PR is disposed inside the paper cassette 1. This pickup roller PR takes out an uppermost one sheet from a stock of sheets stacked up in the paper cassette 1. Near the paper inlet of the developing device 3, a pair of resist rollers RR is disposed as paper aligning rollers. Plural pairs of feed rollers FR1, FR2, . . . are disposed between the pickup roller PR and a pair of resist rollers RR, and by these plural feed rollers FR1, FR2, . . . , a pair of resist rollers RR, photosensitive drum 31, a pair of heating and fixing rollers 41, and pair of exit rollers ER, the paper conveying path is formed as indicated by single dot chain line in FIG. 2. In the example shown in FIG. 2, there are three pairs of feed rollers FR1, FR2, FR3, but this is only an example and it is not limited particularly.

So far, the constitution itself is basically the same as in the prior art described above, but in this paper conveying apparatus, a paper sensor S1 is provided at a predetermined position at the upstream side (feed rollers FR3 side) of the pair of resist rollers RR. This paper sensor S1 is provided in order to detect when the paper taken out from the paper cassette 1 is conveyed up to the predetermined position at the upstream side of the pair of resist rollers RR after passing through the pair of feed rollers FR3. The paper sensor S1 may be specifically transmission type optical sensor, contact type mechanical switch or any other, and it is not particularly limited as far as the leading end of the paper can be detected.

Incidentally, the distance between each pair of rollers and sensor of the paper conveying apparatus shown in FIG. 2 is, for example, as follows. Between pickup roller PR and a pair of feed rollers FR1: 45.2 mm; between pair of feed rollers FR1 and pair of feed rollers FR2: 57.9 mm; between pair of feed rollers FR2 and pair of feed rollers FR3: 124.9 mm; between pair of feed rollers FR1 and pair of resist rollers RR: 114.7 mm, between pair of resist rollers RR and center of photosensitive drum: 38.3 mm; between center of photosensitive drum 31 and pair of heating and fixing rollers 41: 127.5 mm; and between paper sensor S1 and pair of resist rollers RR: 20.2 mm.

In the printer having the paper conveying apparatus as the apparatus of the invention, as shown in FIG. 2, the operation of the printer is as follows. First, one sheet is taken out from the paper cassette 1, and is conveyed to the developing device 3 through the feed rollers FR1, FR2, FR3 and resist rollers RR. On the other hand, data given from a host apparatus not shown (for example, personal computer or word processor) is emitted on the photosensitive drum 31 of the developing device 3 by the optical unit 2, and a latent image is formed. The latent image formed on the photosensitive drum 31 is developed by the toner to be a sensible image, which is transferred on the paper, and the paper is further conveyed to the fixing device 4 to be heated and fixed, and the paper is discharged into a discharge tray 7 through the pair of exit rollers ER.

Figure 3:
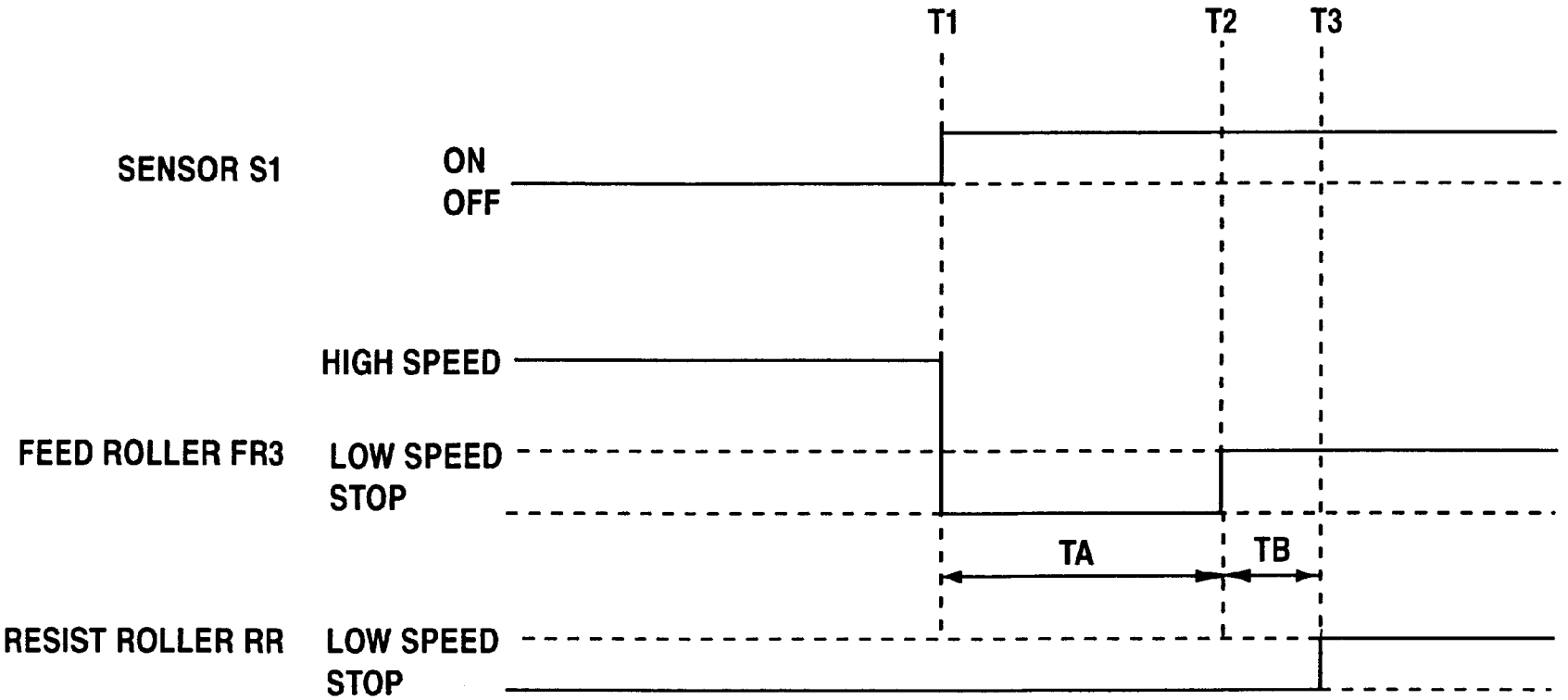
FIG. 3 is a time chart of paper conveying sequence by the apparatus of the invention.

The paper conveying sequence from the paper cassette 1 to the developing device 3 in the above case is described in detail below by referring to the time chart in FIG. 3 showing changes of paper conveying speed by the pair of feed rollers FR3 and pair of resist rollers RR, and the schematic diagram of FIG. 4 showing the position and deflecting state of the paper between the pair of feed rollers FR3 and the pair of resist rollers FF.

When paper conveying is instructed, initially, up to time T1 in FIG. 3, the pair of feed rollers FR3 is driven to rotate at a first paper conveying speed (for example, 627 mm/sec), and the pickup roller PR and other feed rollers FR2, FR3 are driven to rotate at predetermined speed, respectively. However, the pair of resist rollers RR is not driven, but remains stopped. Therefore, the paper P taken out of the paper cassette 1 by the pickup roller PR is conveyed in the sequence of the feed rollers FR1, FR2, FR3, and is conveyed toward the pair of resist rollers RR in the state as shown in FIG. 4A.

Figure 4A:
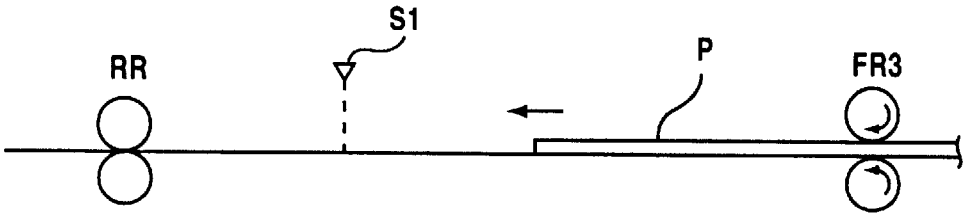
FIG. 4A through FIG. 4D are schematic diagrams showing the position and deflecting state of paper when conveying paper by the apparatus of the invention.
Figure 4B:
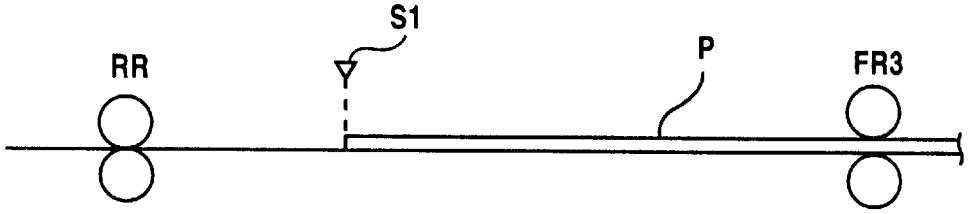

As the paper P is conveyed in the state, shown in FIG. 4A, then the state shown in FIG. 4B, the leading end of the paper P reaches the detecting position of the paper sensor S1. At this time point, that is, at time T1 in FIG. 3, the paper sensor S1 changes to the ON state, and the pair of feed rollers FR3 is stopped once. Accordingly, the paper P stops at the detecting position of the paper sensor S1 20.2 mm upstream of where the leading end collides with the pair of resist rollers RR. Yet, the pair of resist rollers RR remains stopped.

Figure 4C:
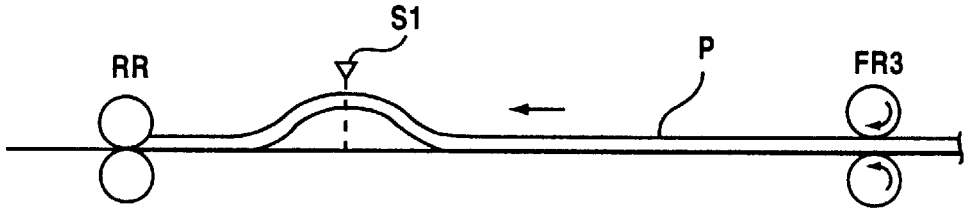

For a predetermined duration TA from the time T1 when the leading end of the paper P reaches the detecting position of the paper sensor S1 until time T2, both the pair of feed rollers FR3 and pair of resist rollers RR are kept in stopped state. That is, the state shown in FIG. 4B is maintained during the predetermined duration TA. At time T2 after lapse of the predetermined duration TA from time T1, first, only the pair of feed rollers FR3 is started, and it is driven to rotate at a second paper conveying speed (for example, 180 mm/sec), equal to the process speed at the developing device 3 and fixing device 4, and relatively lower than the first paper conveying speed. This state continues for a predetermined duration TB from time T2 to T3 in FIG. 3, and in this period, the leading end of the paper P is collided with the contacting portion of the pair of resist rollers RR in stopped state. Thereafter, the leading end of the paper P is arrested at the contacting portion of the pair of resist rollers RR, while it is pushed from behind by the pair of feed rollers FR3 toward the pair of resist rollers RR side at a second speed (for example, 180 mm/sec), and therefore, as shown in FIG. 4C, deflection occurs between the pair of resist rollers RR and pair of feed rollers FR3. By this deflection, the leading end of the paper P is aligned at the contacting portion of the pair of resist rollers RR.

Figure 4D:
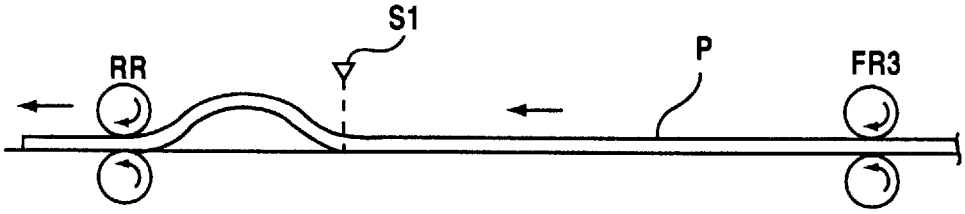

At time T3 after lapse of predetermined duration TB from time T2, the pair of resist rollers RR is started, and it is driven to rotate at the relatively low second paper conveying speed (for example, 180 mm/sec), which is the same as the paper conveying speed of the pair of feed rollers FR3 at this time. In this case, since the paper conveying speed of the pair of feed rollers FR3 and the paper conveying speed of the pair of resist rollers RR are equal, the deflection state shown in FIG. 4C is maintained, and the front portion of the paper P is conveyed by the pair of resist rollers RR, and the rear portion by the pair of feed rollers FR3, so as to be conveyed toward the developing device 3 as shown in FIG. 4D.

Figure 5:
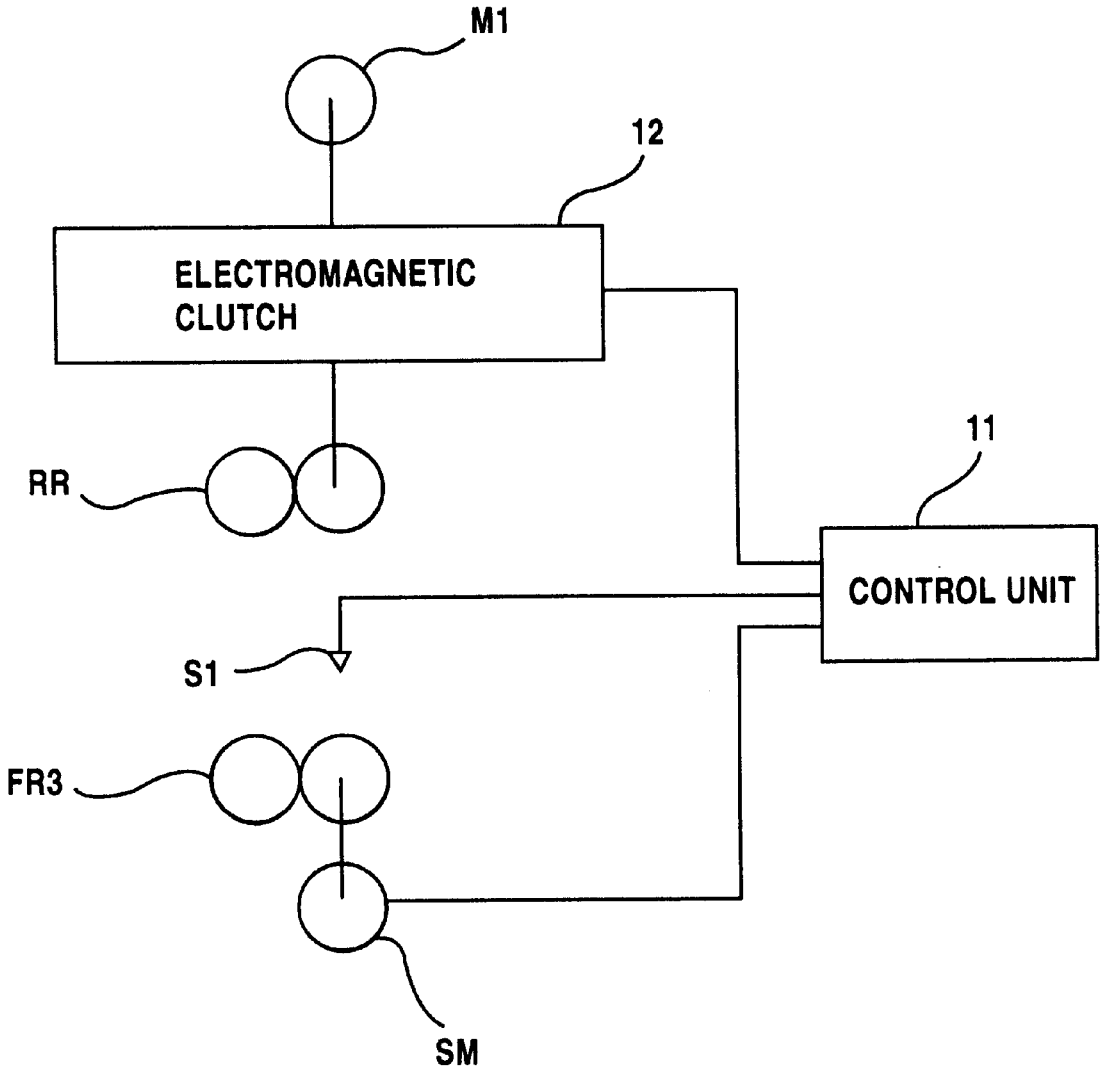
FIG. 5 is a block diagram showing an essential constitution of a control system of the apparatus of the invention.

As the actual constitution of the apparatus, as shown in the block diagram of essential constituent parts of the control system in FIG. 5, the pair of feed rollers FR3 is driven at variable speed by a stepping motor SM, while the pair of resist rollers RR is driven at a constant speed by connecting and disconnecting the rotation of the motor M1 rotating at constant speed by an electromagnetic clutch. The connecting/disconnecting control of the electromagnetic clutch 12 and variable speed drive control of the stepping motor SM are effected by a control unit 11 according to the detection signal of the paper sensor S1. The control unit 11 is composed of CPU, RAM, ROM, etc., and, although not shown in FIG. 5, it is also responsible for control of other feed rollers FR2, FR3, pickup roller PR, pair of exit rollers ER, etc.

In the constitution shown in FIG. 5, the pair of resist rollers RR stops or starts constant speed rotation almost instantly depending on connection or disconnection of the electromagnetic clutch 12, but the stepping motor SM for driving the pair of feed rollers FR3 requires a slight acceleration and deceleration time until reaching a target speed when changing its speed. Therefore, to actually control as shown in the time chart in FIG. 3, it is necessary to control in consideration of the acceleration and deceleration characteristic of the stepping motor for driving the pair of feed rollers FR3.

Figure 6:
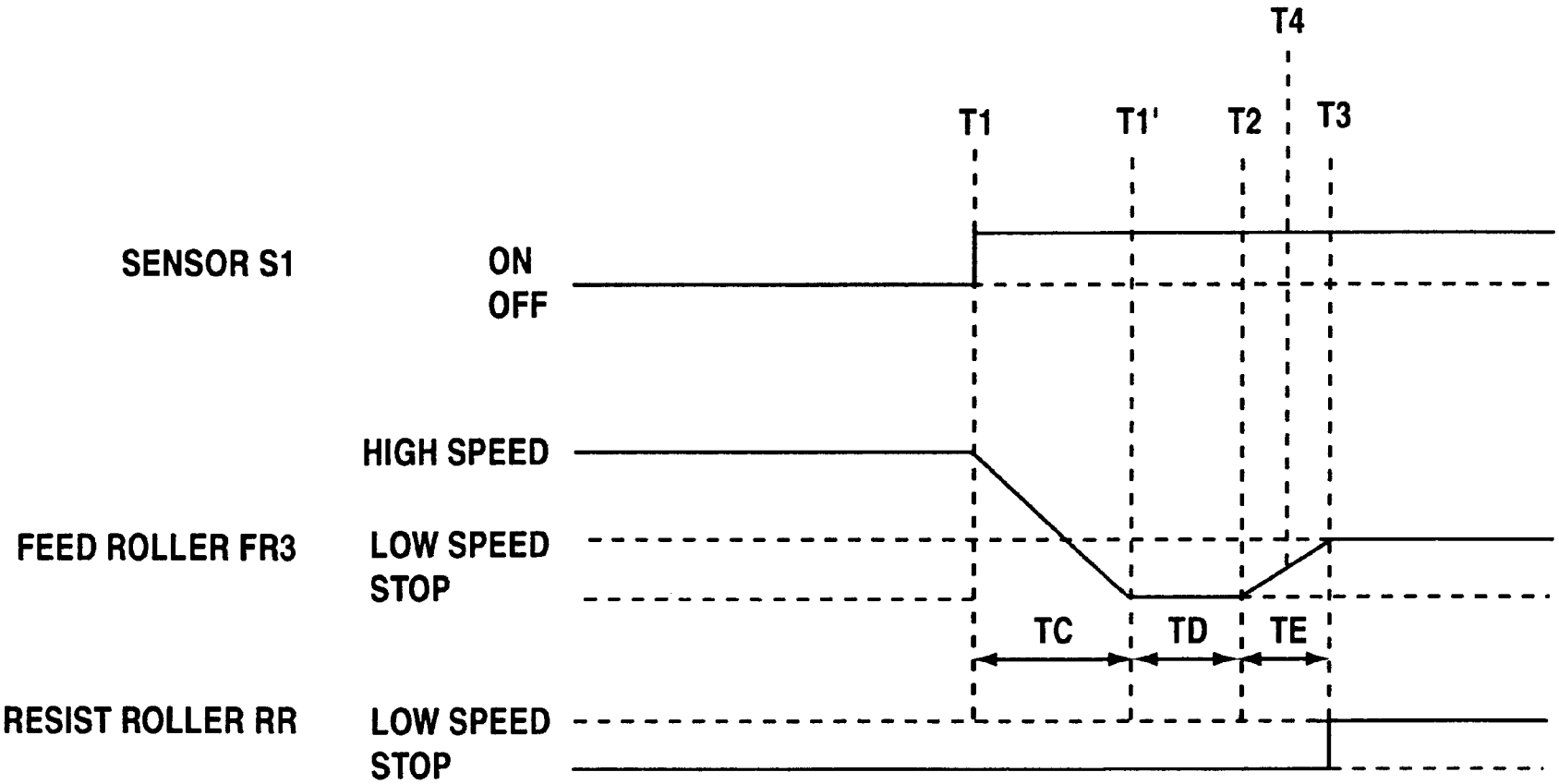
FIG. 6 is a time chart of paper conveying sequence by the apparatus of the invention.

The paper conveying sequence in the actual constitution of apparatus shown in FIG. 5 is specifically described below by referring to the time chart in FIG. 6 showing changes of paper conveying speed by the pair of feed rollers FR3 and pair of resist rollers RR, and the schematic diagram in FIG. 7 showing the position and deflection state of the paper between the pair of feed rollers FR3 and the pair of resist rollers RR.

When the conveyance of the paper P is instructed, initially, like up to time T1 in FIG. 6, the pair of feed rollers FR3 is driven to rotate at a first paper conveying speed of a relatively high speed (for example, 627 mm/sec), and the pickup roller PR and other feed rollers FR2, FR3 are driven to rotate at predetermined speed, respectively. However, the pair of resist rollers RR is not driven, but remains stopped. Therefore, the paper P taken out of the paper cassette 1 by the pickup roller PR is conveyed in the sequence of the feed rollers FR1, FR2, FR3, and is conveyed toward the pair of resist rollers RR in the state shown in FIG. 7A.

Figure 7A:
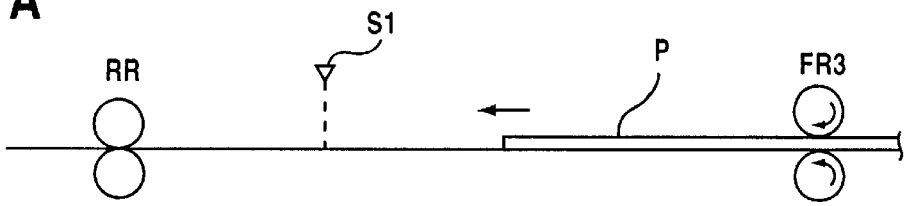
FIG. 7A through FIG. 7F are schematic diagrams showing the position and deflecting state of paper when conveying paper by the apparatus of the invention.
Figure 7B:
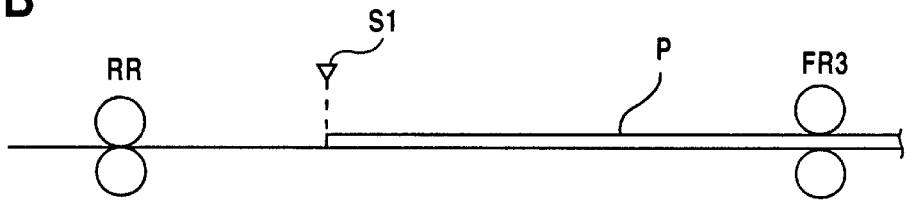
Figure 7C:
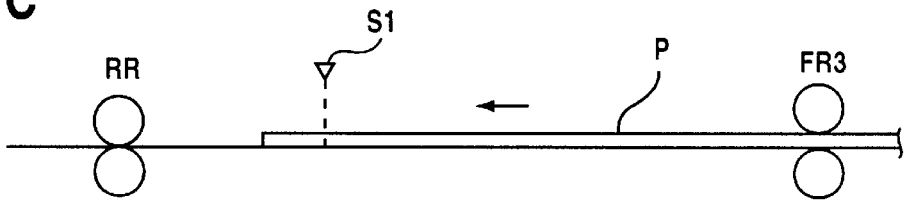

As the paper P is conveyed in the state shown in FIG. 7A, then the state shown in FIG. 7B, the leading end of the paper P reaches the detecting position of the paper sensor S1. At this point, that is, at time T1 in FIG. 6, the paper sensor S1 changes to the ON state, and its signal is fed into the control unit 11. The control unit 11, receiving an ON signal from the paper sensor S1, issues a control signal for stopping the stepping motor SM. As a result, the stepping motor SM is stopped at time T1, but the rotation of the stepping motor SM actually stops at time T1', that is, after the lapse of TC from time T1. At this time T1', as shown in FIG. 7C, the paper P stops at a predetermined position between the paper sensor S1 and pair of resist rollers RR. Still, the pair of resist rollers RR remains stopped.

Figure 7D:
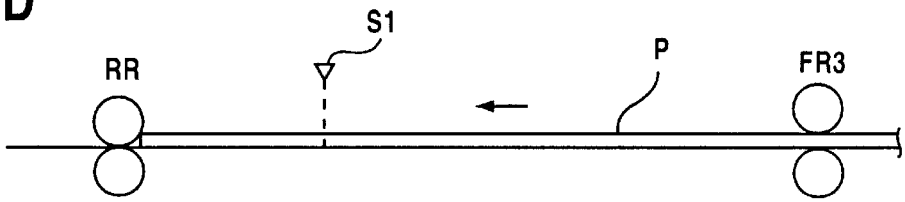
Figure 7E:
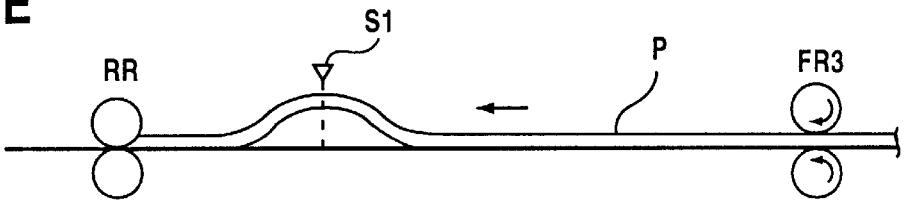

For a predetermined duration TD from time T1' till time T2, the feed rollers FR3 and resist rollers RR are both kept in stopped state. That is, the state shown in FIG. 7C is maintained for the predetermined duration TD. After the lapse of the predetermined duration TD, at time T2, first, only the pair of feed rollers FR3 is started. More specifically, the control unit 11 starts clocking from time T1 when the paper sensor S1 detects the paper P, and at time T2 after lapse of duration TC+TD, issues a control signal for driving to rotate only the stepping motor SM at a second paper conveying speed (for example, 180 mm/sec) of a relatively low speed equal to the process speed of the developing device 3 and fixing device 4. As a result, the stepping motor SM starts at time T2 in FIG. 6, and accelerates to the speed specified by the control unit 11 for a predetermined duration TE until time T3. At a certain time T4 during duration TE, as shown in FIG. 7D, the leading end of the paper P collides with the pair of resist rollers RR in stopped state, and thereafter until time T3, the paper P is stopped with the leading end arrested at the contacting portion of the pair of resist rollers RR, and is pushed from behind by the pair of feed rollers FR3 toward the pair of resist rollers RR side at the second paper conveying speed (for example, 180 mm/sec), so that a deflection occurs in the paper between the resist rollers RR and feed rollers FR3 as shown in FIG. 7E. By this deflection, the leading end of the paper P is aligned uniformly to the contacting portion of the pair of resist rollers RR.

Figure 7F:
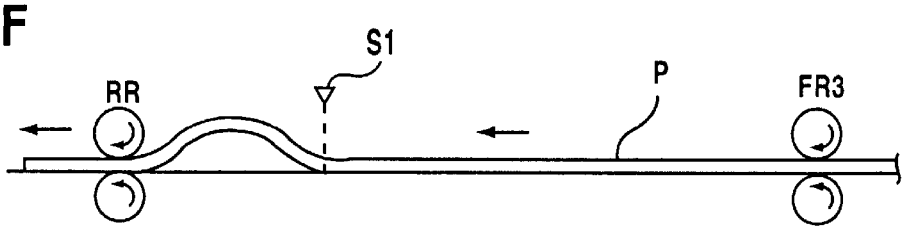

Consequently, at time T3 after lapse of predetermined duration TE from time T2 when the stepping motor SM is started, in other words, at the moment the stepping motor SM is sufficiently accelerated to the speed specified by the control unit 11, the control unit 11 issues a control signal for connecting the electromagnetic clutch 12. As a result, the resist motor RR immediately starts rotation at a constant rotating speed of the motor M1 (for example, a rotating speed corresponding to the paper conveying speed of 180 mm/sec). Since the paper conveying speed by the resist rollers RR is the same as the paper conveying speed by the feed rollers FR3 at this time, the deflection state shown in FIG. 7E is maintained, and the front portion of the paper P is conveyed by the resist rollers RR and the rear portion by the feed rollers FR3, and it is conveyed from the resist rollers RR to the developing device 3 as shown in FIG. 7F.

In the embodiment, the paper conveying speeds (relatively fast first conveying speed of 627 mm/sec and relatively slow second conveying speed of 180 mm/sec) are only examples, and other numerical values may be employed depending on the physical dimensions of the apparatus or paper conveying quantity per unit time.

Further, in the embodiment, the distance between rollers or between sensors is only an example, and may also have different values.

In the embodiment, the sheet like object conveying method and apparatus of the invention are applied in the paper conveying apparatus of an electrophotographic printer, but it may also be applied to similar electrophotographic apparatuses such as copying machine and facsimile apparatus, and, not limited to electrophotographic apparatus, it may further be applied to a scanner of a type conveying stacked sheets of paper to be read continuously to the scanning position, or the like.

Moreover, the invention may be applied not only to a printing paper conveying apparatus as described above, but also to a general sheet like object conveying apparatus.

According to the sheet like object conveying method and its apparatus of the invention described herein, the conveying object collides with the resist rollers provided on the way of the conveying path in the lowered state of motion energy, and therefore the conveying object is securely arrested by the resist rollers. Hence, slipping-out of the leading end of the conveying object from the resist rollers is prevented, which extremely lowers the possibility of occurrence of error in the position of the conveying object after passing the resist rollers.

Besides, the conveying object is controlled to stop once before the resist rollers, and it is possible to control a desired deflection amount when the conveying object collides with the resist rollers and deflects. As a result, oblique running of the conveying object after passing through the resist rollers is securely prevented, and thereby so-called jamming is decreased.

Further, the impact noise generated conventionally when the conveying object collides with the resist rollers, especially the impact noise when the conveying object is thick paper, is suppressed, and the apparatus noise level can be lowered.

As the invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

We claim:

1. A sheet-like object conveying method for conveying one piece of sheet like object to be conveyed by feed rollers to collide with a pair of resist rollers in stopped state to align the leading end side in a direction orthogonal to the conveying direction, and then driving both said feed rollers and said resist rollers to convey the object to be conveyed aligned at the leading end side by said resist rollers to a next process, comprising the steps of:

controlling the rotating speed of said feed rollers so that said object is conveyed at a first speed toward said resist rollers;

controlling the rotating speed of said feed rollers so that said object is conveyed at a second speed which is lower than the first speed from a predetermined position before said object collides with said resist rollers until it collides with said resist rollers; and stopping the rotation of said feed rollers between said two steps.

2. The sheet like object conveying method of claim 1, wherein the first speed is controlled not to exceed 627 mm/sec, and the second speed is controlled not to drop below 180 mm/sec so as to enable the object to collide with the resist rollers at a speed of not lower than 180 mm/sec.

3. A sheet like object conveying apparatus incorporating feed rollers driven by a stepping motor and a pair of resist rollers driven or stopped by connecting or disconnecting the rotation of a constant speed rotating motor by a mechanical clutch, for conveying one piece of sheet like object to be conveyed by said feed rollers at a first speed to collide with said resist rollers in stopped state to align the leading end side in a direction orthogonal to the conveying direction, and then synchronizing said feed rollers and said resist rollers to convey said object to be conveyed at a second speed lower than said first speed, comprising:

a detector for detecting that the leading end of said object to be conveyed reaches a predetermined position at the upstream side of said resist rollers; and control means for driving said stepping motor so as to convey said object to be conveyed at the first speed until said detector detects the leading end of said object to be conveyed, once stopping the driving of said stepping motor when said detector detects the leading end of said object to be conveyed, then starting to drive said stepping motor so that said object to be conveyed may be conveyed at the second speed, and controlling said mechanical clutch in connection state when said stepping motor reaches the rotating speed for conveying said object to be conveyed at the second speed, and after the leading end of said object to be conveyed collides with said resist rollers.

4. A sheet like object conveying apparatus as set forth in claim 3, wherein said mechanical clutch is composed of a electromagnetic clutch.

5. The sheet like object conveying apparatus of claim 3, wherein the first speed is controlled not to exceed 627 mm/sec, and the second speed is controlled not to drop below 180 mm/sec so as to enable the object to collide with the resist rollers at a speed of not lower than 180 mm/sec.

6. A printer comprising:

a paper conveying apparatus having feed rollers driven by a stepping motor, a pair of resist rollers driven or stopped by connecting or disconnecting the rotation of a constant speed rotating motor by a mechanical clutch, a detector for detecting that the leading end of said printing paper reaches a predetermined position at the upstream side of said resist rollers, and a control unit for driving said stepping motor so that said printing paper may be conveyed at a first speed until said detector detects the leading end of said printing paper, once stopping the driving of said stepping motor when said detector detects the leading end of said printing paper, then starting to drive said stepping motor so that said printing paper may be conveyed at a second speed lower than the first speed, and controlling said mechanical clutch in connection state when said stepping motor reaches the rotating speed for conveying said printing paper at the second speed, and after the leading end of said printing paper collides with said resist rollers, to synchronize said feed rollers and said resist rollers, thereby conveying said printing paper at the second speed lower than said first speed; and a printing apparatus for printing on said printing paper conveyed at said second speed at the downstream side of said resist rollers.

7. A printer as set forth in claim 6, wherein said mechanical clutch is composed of a electromagnetic clutch.

8. The printer of claim 6, wherein the first speed is controlled not to exceed 627 mm/sec, and the second speed is controlled not to drop below 180 mm/sec so as to enable the object to collide with the resist rollers at a speed of not lower than 180 mm/sec.

* * * * *